US006039232A

United States Patent [19]

Snover

[11] Patent Number: 6,039,232

[45] Date of Patent: Mar. 21, 2000

[54] LINE FEEDING DEVICE FOR STAPLE GUNS

[76] Inventor: David Snover, 600 Ford St., Golden, Colo. 80430

[21] Appl. No.: 09/090,548

[22] Filed: Jun. 4, 1998

[51] Int. Cl.[7] ..... B25C 7/00

[52] U.S. Cl. ..... 227/150; 227/18; 227/46; 227/120; 227/156

[58] Field of Search ..... 227/120, 150, 227/156, 45, 46, 47, 12, 13, 76, 18

[56] References Cited

U.S. PATENT DOCUMENTS

| | | | |
|---|---|---|---|
| 1,272,694 | 7/1918 | Maynard | 227/150 |
| 1,658,626 | 2/1928 | Allen | 227/150 |
| 1,846,945 | 2/1932 | Bliss et al. | 227/150 |
| 2,331,509 | 10/1943 | Scheckwitz | 227/120 |
| 2,996,720 | 8/1961 | Mackechnie | 227/76 |
| 3,283,986 | 11/1966 | McKee | 227/120 |
| 3,319,864 | 5/1967 | Adams | 227/120 |
| 3,385,498 | 5/1968 | Downie | 227/18 |
| 3,476,301 | 11/1969 | Auston | 227/156 |
| 3,476,302 | 11/1969 | Hurd | 227/120 |
| 4,232,810 | 11/1980 | Russell | 227/12 |
| 4,729,164 | 3/1988 | Steeves | 227/156 |
| 5,014,896 | 5/1991 | Reitmeier et al. | 227/150 |
| 5,292,048 | 3/1994 | Vanderwiel | 227/47 |
| 5,660,315 | 8/1997 | Beavers et al. | 227/156 |

*Primary Examiner*—Peter Vo
*Assistant Examiner*—Jim Calve
*Attorney, Agent, or Firm*—Henderson & Sturm LLP

[57] ABSTRACT

A line feeding device 10 for releasable engagement with a staple gun 100 wherein the device 10 includes a line feeding unit 11 provided with a mounting unit 12 for attachment of the line feeding unit 11 to the staple gun 100 for delivering a supply of line 31 through the staple feeding magazine 103 of the staple gun 100. A line guide unit 13 positions the line 31 proximate a rear opening 108 in the staple gun 100.

4 Claims, 3 Drawing Sheets

LINE FEEDING DEVICE FOR STAPLE GUNS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of stapling devices in general, and in particular to a line feeding device for a staple gun.

2. Description of Related Art

As can be seen by reference to the following U.S. Pat. Nos. 1,272,694; 1,658,626; 1,846,945; and 5,014,896, the prior art is replete with myriad and diverse stapling devices.

While all of the aforementioned prior art constructions are more than adequate for the basic purpose and function for which they have been specifically designed, they are uniformly deficient with respect to their failure to provide a simple, efficient, and practical clip on accessory for a staple gun that will feed string or wire line through the stick of staples that are contained in the magazine of the staple gun.

As most construction workers are well aware, there are many instances wherein a visual alignment means would assist the operator of a staple gun in distributing the staples in accordance with a particular pattern.

Unfortunately, to date no one has developed a method or system that will accomplish that objective, and the usual solutions resorted to such as chalk lines and stretched lengths of string are highly unsatisfactory, coupled with the fact that these prior art methods would not provide the staple gun operator with a quick visual reference of the surface area that had already been traversed by the staple gun.

As a consequence of the foregoing situation, there has existed a longstanding need among construction workers for a new and improved clip on line feeding device for staple guns that feeds a supply of line through the staple gun magazine, and the provision of such a construction is a stated objective of the present invention.

BRIEF SUMMARY OF THE INVENTION

Briefly stated, the line feeding device for staple guns that forms the basis of the present invention comprises in general, a line supply unit, a mounting unit for releasably attaching the line supply unit to a staple gun and a line guide unit for positioning the line relative to a selected portion of the staple gun.

As will be explained in greater detail further on in the specification, the line feeding device comprises a simple version that is particularly well suited for attachment to a specific pneumatic staple gun and a more complex version that is more suitable for electric staple guns.

In both versions of this invention, the line supply unit and a portion of the mounting unit are identical and include a supply of line rotatably suspended within a housing member wherein the housing member is provided with a mounting bracket.

In the more complex version of the device, the housing member is provided with the line guide unit and the mounting bracket is adapted to be connected to either a generally resilient adapter element or a semi-rigid adapter element. The resilient adapter element comprises a contoured leaf spring that frictionally engages the front portion of the staple gun. The semi-rigid adapter element comprises a collar that has a locking knob for locking the collar to the front portion of the staple gun.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
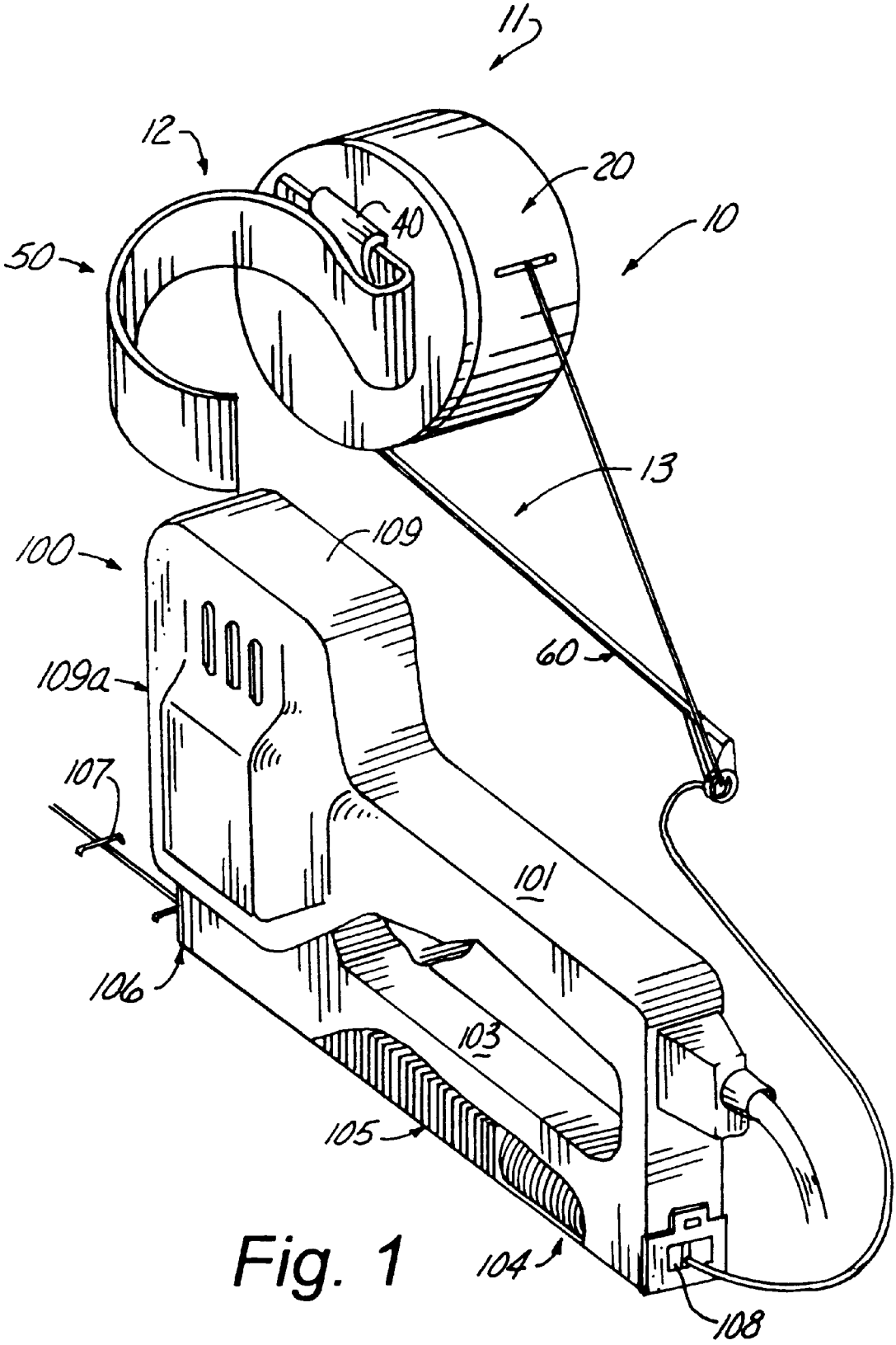
FIG. 1 is a perspective view of the line feeding device of this invention installed on an electric staple gun.

As can be seen by reference to the drawings, and in particularly to FIG. 1, the line feeding device that forms the basis of the present invention is designated generally by the reference number 10. The line feeding device 10 comprises in general, a line supply unit 11, a mounting unit 12, and a line guide unit 13. These units will now be described in seriatim fashion.

Prior to embarking on a detailed description of the line feeding device 10, it would first be advisable to describe a typical staple gun construction 100 that the line feeding device 10 is designed to be operated in conjunction with.

As shown in FIGS. 1 and 4, the staple gun 100 can be of either the electric or pneumatic variety. The staple gun 100 has an upper housing 101 containing a conventional trigger actuated staple driving mechanism (not shown) and a lower housing 103 which comprises a conventional staple feeding magazine dimensioned to receive a stick of staples 105. The bottom of the lower housing 103 has a front opening 106 dimensioned to receive the ejected staples 107 and a rear opening 108 formed adjacent to the back end of the staple feeding magazine 104.

Figure 2:
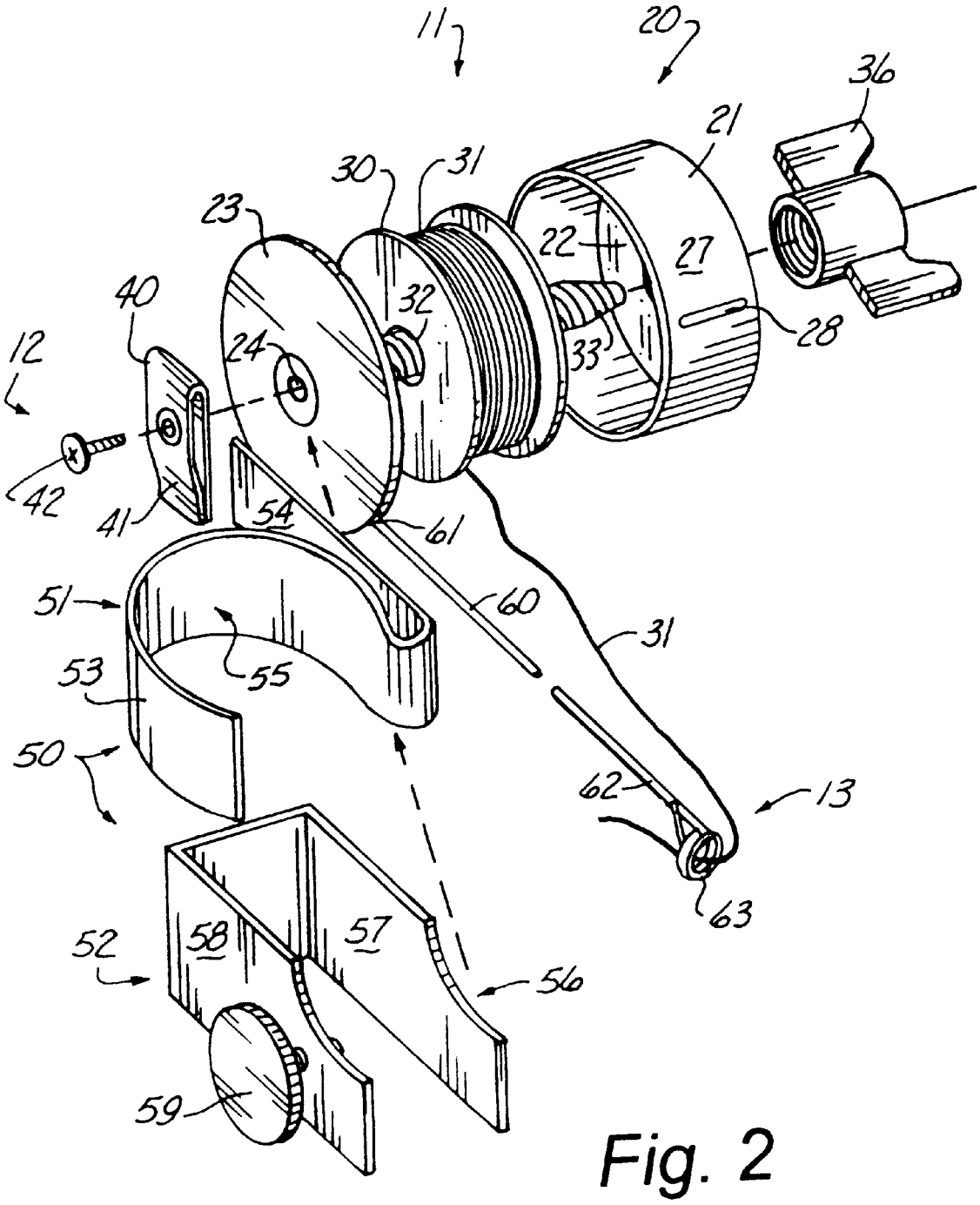
FIG. 2 is an exploded perspective view of the line supply unit and two variations of the mounting unit.

Turning now to FIG. 2, it can be seen that the line feeding unit 11 comprises a cylindrical housing member 20 including a generally cylindrical housing receptacle 21 having raised sidewalls 27 equipped with a dispensing slot 28 and an apertured rear wall 22 and an apertured housing lid 23. The apertures 24 in the lid 23 and the rear wall 23 are aligned with one another and centrally disposed relative to the rear wall 22 and the lid 23 for reasons that will be explained presently.

Still referring to FIG. 1, it can be seen that the line supply unit 11 further comprises a spool member 30 provided with a supply of line 31 that can be fabricated from wire, string, etc. The spool member 30 is provided with a central aperture 32 dimensioned to receive an axle element 33.

In the preferred embodiment of the invention illustrated in the drawings, the axle element 33 is fixedly engaged on one end to the lid 23 of the housing member 20 wherein the other end of the axle element 33 is threaded and dimensioned to be received in the central aperture 24 in the rear wall 22 of the housing member 20 and to be threadedly engaged by a fastening element 36 for captively engaging the spool member 30 within the housing member 20 and operatively connecting the lid 23 to the housing receptacle 21 such that the free end of the supply of line 31 can be threaded through the slot 28 in the sidewalls 27 of the housing member 20 to dispense the line 31 in a well recognized fashion.

As can also be seen by reference to FIG. 2, the mounting unit 12 comprises in general, a bracket member 40 securely fastened to the lid 23 of the housing member 20 and an adapter member designated generally as 50 adapted to be releasably received by said clip member 40.

In the preferred embodiment of the invention depicted in FIGS. 1 and 2, the bracket member 40 comprises a generally U-shaped clip element 41 provided with a fastener 42 for operatively attaching the bracket member clip element 41 to the lid member 23 and to captively engage a portion of the adapter member 50 between the legs of the U-shaped clip element 41.

As can also be seen by reference to FIG. 2, the adapter member 50 can comprise a variety of differently configured resilient and semi-rigid adapter elements 51, 52, etc. In the preferred embodiment of the invention the resilient adapter element 51 comprises a contoured leaf spring 53 having a generally straight mounting arm 54 dimensioned to be received in the bracket member 40 and provided with a generally C-shaped clamp portion 55 dimensioned to receive and frictionally engage the front portion 109 of the staple gun 100.

In the alternate version of the preferred embodiment likewise shown in FIG. 2, the semi-rigid adapter element 52 comprises a generally rigid U-shaped collar 56 dimensioned to closely conform to the front 109 of the staple gun 100 and having one leg 57 dimensioned to be received by the bracket member 40. The other leg 58 of the collar 56 is provided with a locking knob 59 for fixedly securing the adapter element 52 to the front portion 109 of the staple gun.

Figure 3:
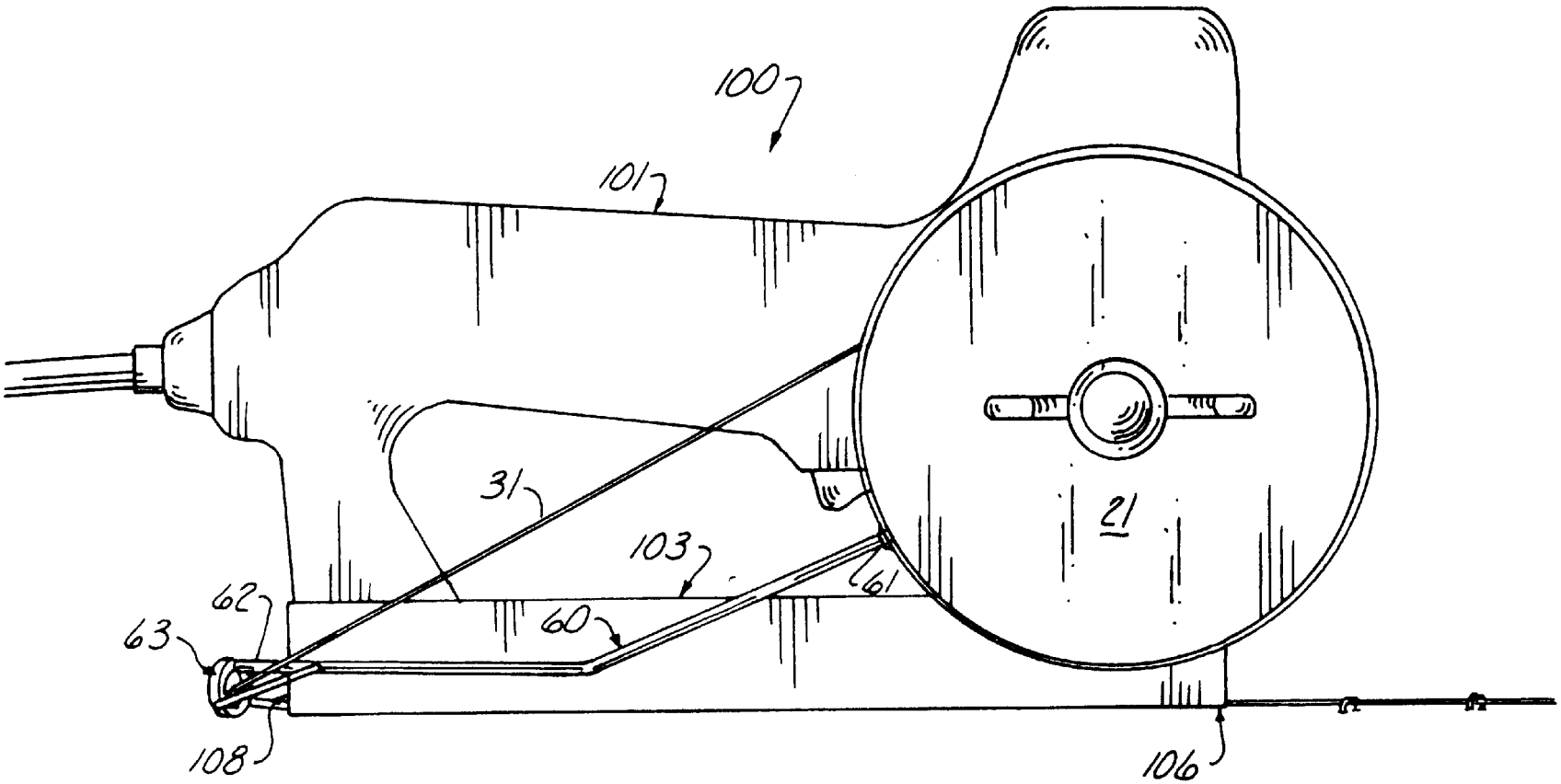
FIG. 3 is a side plan view of the line feeding device installed on an electric staple guns.

As can best be seen by reference to FIGS. 1 through 3, the line guide unit 13 comprises an elongated rod member 60 having an inboard end 61 fixedly secured to the housing lid 23. The outboard end 62 of the rod member 60 is further provided with an eyelet element 63 dimensioned to receive the line 31 and position the intermediate portion of the line 31 adjacent the rear opening 108 of the staple gun 100, so that the line 31 can be fed through the rear opening 108, the stick of staples 105 and the front opening 106.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A detachable line feeding device for a conventional staple gun having an upper housing with lateral sides including a trigger actuated staple driving mechanism, and a lower housing including a staple feeding mechanism and having a rear housing opening and a front bottom opening dimensioned to receive a driven staple wherein the line feeding device comprises:

a line feeding unit comprising a housing member including a housing receptacle and a housing lid wherein the housing receptacle is provided with a line feeding aperture, an axle element suspended within the housing member, and a spool member rotatably disposed on the axle element and provided with a supply of line dimensioned to pass through said line feeding aperture;

detachable means for mounting said line feeding unit in an offset fashion adjacent to a selected lateral side of the front of the upper housing of the staple gun; and a line guide unit including an elongated rod member having a first end affixed to the housing member; and a second end provided with an eyelet element dimensioned to receive said line; wherein the second end is positioned adjacent the rear housing opening of the staple gun such that the line can be fed from the rear housing opening to the front bottom opening of the staple gun.

2. The detachable line feeding device as in claim 1 wherein the detachable means for mounting said line feeding unit in an offset fashion adjacent to a selected lateral side of the upper housing of the staple gun comprises:

a bracket member fixedly secured on one side of the housing member; and an adapter member associated with the bracket member and having an opening dimensioned to releasably receive the upper housing of the staple gun.

3. The line feeding device as in claim 2 wherein the adapter element comprises:

a contoured leaf spring having a generally straight mounting arm adapted to be received in the bracket member and a generally C-shaped clamp portion dimensioned to frictionally engage the upper housing of the staple gun.

4. The line feeding device as in claim 2 wherein the adapter element comprises:

a generally rigid U-shaped collar dimensioned to receive the front portion of the staple gun and having one leg adapted to be received in the bracket member and the other leg provided with a locking knob for fixedly securing the collar to the upper housing of the staple gun.

* * * * *